US011191369B2

(12) United States Patent
Martinez

(10) Patent No.: US 11,191,369 B2
(45) Date of Patent: Dec. 7, 2021

(54) CHILDREN'S PLAYPEN MATTRESS WITH RIGID SUBSTRATE AND INFLATABLE BLADDER

(71) Applicant: William Martinez, New York, NY (US)

(72) Inventor: William Martinez, New York, NY (US)

( * ) Notice: Subject to any disclaimer, the term of this patent is extended or adjusted under 35 U.S.C. 154(b) by 251 days.

(21) Appl. No.: 16/432,582

(22) Filed: Jun. 5, 2019

(65) Prior Publication Data

US 2019/0365119 A1 Dec. 5, 2019

Related U.S. Application Data

(60) Provisional application No. 62/680,850, filed on Jun. 5, 2018.

(51) Int. Cl.
*A47D 15/00* (2006.01)
*A47D 13/06* (2006.01)
(Continued)

(52) U.S. Cl.
CPC ..... *A47D 15/003* (2013.01); *A45F 3/14* (2013.01); *A47D 13/063* (2013.01); *A45F 2003/142* (2013.01); *A47C 27/082* (2013.01)

(58) Field of Classification Search
CPC .... A47D 15/003; A47D 13/063; A47C 27/08; A47C 27/081; A47C 27/082; A47F 3/14; A45F 2003/142
See application file for complete search history.

(56) References Cited

U.S. PATENT DOCUMENTS 3,049,728 A 8/1962 Lund
4,003,098 A 1/1977 Fink
(Continued)

FOREIGN PATENT DOCUMENTS

CN 201577898 U 9/2010
CN 203059054 U 7/2013

OTHER PUBLICATIONS

The Greenhead; "AirCrib—Inflatable Travel Crib"; downloaded from internet on Jun. 14, 2018. https://www.thegreenhead.com/2008/01/aircrib-inflatable-travel-crib.php.
(Continued)

*Primary Examiner* — Eric J Kurilla
(74) *Attorney, Agent, or Firm* — St Onge Steward Johnston and Reens LLC

(57) ABSTRACT

A mattress for a children's playpen or play-yard product using a hard substrate layer and an inflatable bladder to improve comfort, the hard substrate layer including a plurality of rigid substrate sections rotateably attached to one another allowing the mattress's hard substrate layer to lie flat when in use as a mattress and to fold into multilateral shapes when in use as a carrying case, the inflatable bladder improving the comfort of the mattress when inflated and in use as a mattress and still allowing the mattress to operate as an effective carrying case when deflated. The children's playpen or play-yard product also includes a collapsible frame assembly with an air compressor mounted thereto, in preferable embodiments, the air compressor being detachably connectable to the mattress's inflatable bladder to quickly inflate and/or deflate the mattress to facilitate its multifunctional use.

20 Claims, 15 Drawing Sheets

(51) Int. Cl.
*A47C 27/08* (2006.01)
*A45F 3/14* (2006.01)

(56) References Cited

U.S. PATENT DOCUMENTS

| | | | | |
|---|---|---|---|---|
| D276,384 | S | 11/1984 | Kroll | |
| 4,815,153 | A | 3/1989 | Bleser et al. | |
| 5,461,741 | A * | 10/1995 | Graebe | A47C 4/54 5/654 |
| 5,673,924 | A | 10/1997 | Demick et al. | |
| 6,951,039 | B2 * | 10/2005 | Roseff | A47C 27/082 5/654 |
| 7,661,157 | B2 | 2/2010 | McCluskey et al. | |
| 7,752,693 | B2 | 7/2010 | Espenshade | |
| 7,895,692 | B1 | 3/2011 | Pour | |
| 8,365,323 | B2 | 2/2013 | Crumrine | |
| 8,566,988 | B2 * | 10/2013 | Son | A47D 7/04 5/690 |
| 2003/0196263 | A1 | 10/2003 | Hardy | |
| 2006/0123551 | A1 * | 6/2006 | Hsia | A47C 23/06 5/706 |
| 2011/0191955 | A1 | 8/2011 | Wu | |
| 2016/0286982 | A1 | 10/2016 | Smith | |
| 2017/0360218 | A1 * | 12/2017 | Dziak | A47D 13/063 |

OTHER PUBLICATIONS

Amazon.com; "Folding Pack-n-Play Mattress by Sproutwise"; dowloaded from internet on Jun. 15, 2108. https://www.amazon.com/Folding-Pack-n-Play-Mattress-Sproutwise-Kids/dp/B00RZWK7EU/ref-sr_1_14_a_it?ie=UTF8&qid=1529021831&sr=8-14&keywords=mattress%2Bfor%2Bplay%2Band%2Bpack&th=1.

Amazon.com; "Babbaco Babbamat Self Inflatable Sleep Play Portable"; retrieved from internet on Jun. 15, 2018. https://www.amazon.com/Babbaco-Babbamat-Inflatable-Sleep-Portable/dp/B004X8J1NC.

Amazon.com; "Tuck-Me-In Travel Bed with Removable Mattress", retreived from internet Jun. 15, 2018. www.amazon.com/Tuck-Me-Travel-Removable-Mattress-TODDLER/dp/B005EDW2AY.

* cited by examiner

CHILDREN'S PLAYPEN MATTRESS WITH RIGID SUBSTRATE AND INFLATABLE BLADDER

FIELD OF THE INVENTION

The technology relates to entertainment products for infants and young children. More specifically, the technology relates to a mattress design for a children's playpen or play-yard product.

BACKGROUND OF THE INVENTION

Children's transportable playpen or play-yard products, such as the well-known Pack 'n Play®, are well known to parents of young children. These products provide an entertainment environment for a child or infant with easy and convenient mobility. The typical playpen or play-yard combines a collapsible frame assembly, which expands upon set-up to create an enclosed environment, with a mattress pad that doubles as an external shell that surrounds and encloses the frame assembly when collapsed. When in its collapsed and enclosed state, the playpen is easy to store and transport between locations. When unpacked and set up, the playpen provides an enclosed environment in which a child is protected from potential hazards in the surrounding environment.

The state-of-the-art playpen or play-yard product is generally stored in its collapsed and enclosed position. To use the playpen, a user removes it from its carrying case, if included, removes and unfolds the surrounding mattress pad (the mattress pad itself may operate as the carrying case), and manipulates the various components of the frame assembly, locking them into an upright and assembled position. The typical playpen expands to create a four-sided, square or rectangular environment. Once the frame is set up, the mattress pad is placed inside the frame assembly and acts as the bottom of the enclosed environment upon which the child or infant stands or rests. To disassemble the playpen, the mattress is removed from within the frame assembly, the frame assembly is collapsed back into its storage state, and the mattress is folded around the collapsed frame assembly to enclose the entire product and provide for easy transportation.

Current playpen or play-yard products suffer from certain drawbacks, however. Because the mattress pad is used to enclose the frame assembly when in the storage/transport position, the mattress cannot be too bulky. As a result, the mattress padding is insufficient in many cases. This is especially problematic as a child grows, as he or she becomes heavier and therefore requires additional padding to remain comfortable. The same is true if a child remains in the playpen for an extended period of time. Thus, there is a need in the art for a playpen or play-yard product, and specifically for a mattress pad therefor, that improves the comfort of the mattress pad but maintains the ability to operate to surround and enclose the product's frame assembly for convenient storage and transport.

SUMMARY OF THE INVENTION

Accordingly, it is an object of the present invention to provide a mattress for a children's playpen or play-yard product that is more comfortable than those used in the state-of-the-art product but remains capable of use as a carrying case for the product when the frame assembly is in its collapsed state. It is a further object of the present invention to include such a mattress with a playpen or play-yard product or to replace the mattress included with current products with the more comfortable but still versatile mattress pad of the present invention.

To achieve these objectives, a mattress of the present invention includes a hard substrate layer and an inflatable bladder. Preferable embodiments also include a foam pad, with the inflatable bladder arranged between the hard substrate layer and the foam pad. The inflatable bladder includes one or more air chambers capable of inflating and deflating as necessary. Each air chamber may include an air valve to facilitate inflation and deflation, or a single air valve may be used to facilitate inflation and deflation of all of the inflatable bladder's air chambers in some embodiments. The air valve or valves are preferably easily accessible from the outside of the mattress, allowing a user to connect an air source for inflation and to access an air release mechanism for deflation. Air sources can include hand or foot pumps, electronic air compressors, or other means of supplying air to the inflatable bladder, as will be known to those of ordinary skill in the art.

The mattress's hard substrate layer is intended to form a shell around the collapsed playpen or play-yard during transport. To achieve this effect, the hard substrate layer includes multiple rigid substrate sections that are attached to one another in such a way so as to allow the rigid substrate sections to rotate along a plane respective to one another. This flexible connection permits the rigid substrate sections to lay flat and form a flat base for the mattress when installed in the unpacked playpen. The flexible connection also allows the rigid substrate sections to fold relative to one another so that the mattress forms an outer shell surrounding the other components of the playpen when in a storage/transport position.

Preferable embodiments of the hard substrate layer include four rigid substrate sections, equally sized so as to form a square when folded up into the storage/transport position. However, those of ordinary skill in the art will recognize that other shapes, such as triangles, hexagons, octagons, etc., are also possible and a hard substrate layer with four rigid substrate sections may fold up into other quadrilateral shapes, such as a rectangle or rhombus. Furthermore, a hard substrate layer with five rigid substrate sections may be used to fold into a quadrilateral shape, wherein two of the rigid substrate sections overlap when the mattress is in the storage/transport position. Those of ordinary skill in the art will recognize the many variations of the composition of the hard substrate layer available to achieve the desired effect.

The hard substrate layer is preferably made of a hard plastic or wood material, though any rigid material may be used. Likewise, the foam pad is preferably made of a soft, cushion-like material as is commonly used for foam mattress pads known in the art, though other padding materials or cushions may also be used. Preferable embodiments of the mattress also include one or more layers of an expandable fabric. The expandable fabric surrounds the various layers of the mattress and holds them in place relative to one another. For example, the expandable fabric may simply surround the outer edges of each of the foam pad, inflatable bladder, and hard substrate layer, holding each adjacent to the others. Other preferable embodiments may further include layers of expandable fabric between the various layers, such as between the foam pad and the inflatable bladder and/or between the inflatable bladder and the hard substrate layer. Still other preferable embodiments may include one or more stiches connecting the expandable fabric to the foam pad, the inflatable bladder, and/or the hard substrate layer. Such stiches help to prevent the layers from shifting relative to one another and becoming misaligned.

In some preferable embodiments of the invention, the expandable fabric may be used to connect the rigid substrate sections of the hard substrate layer. In such embodiments, each rigid substrate section could be surrounded by the expandable fabric, and the expandable fabric could attach each rigid substrate section to the others with planes of rotation between the rigid substrate sections where only the expandable fabric is present. The expandable fabric may also comprise one or more sections of base layer fabric, which may be of similar material as the other portions of the expandable fabric and/or may be of more rigid material to more reliably hold the rigid substrate sections of the hard substrate layer in place and adjacent to one another. Such embodiments could be combined with hinges between the rigid substrate sections or other manners of rotateably connecting the rigid substrate sections. Those of ordinary skill in the art will understand the different manners of connecting the rigid substrate sections that will allow the hard substrate layer to lay flat in the unpacked position and to form a multi-sided carrying case for the playpen or play-yard product when in the storage/transport position. Whatever the composition of the expandable fabric, it importantly includes one or more slots aligned with the one or more air valves of the inflatable bladder to permit access to the air valves for inflating and deflating the air.

The objectives of the present invention are further achieved by including the mattress described with a children's playpen or play-yard product. Such embodiments include, along with the mattress, a collapsible frame assembly that unfolds and assembles to form the entertainment environment. Such embodiments also preferably include an air compressor and means for attaching the air compressor to the one or more air valves on the mattress's inflatable bladder, though the air compressor may be replaced with an air pump or other means of supplying air. In preferable embodiments employing an air compressor, the air compressor is preferably affixed to the collapsible frame assembly. In this way, the air compressor is part-in-parcel to the playpen or play-yard product and folds up along with the collapsible frame assembly for easy storage and transport.

As noted, the preferable embodiments of the playpen or play-yard product including an air compressor also preferably include detachable means for connecting the air compressor to the air valve(s) of the inflatable bladder to facilitate easy, hands-free inflation of the mattress. Such means may include a hose, tube, or other device capable of transferring air from the compressor to the air valve. In addition, preferable embodiments include a quick-connect assembly making rapid attachment and disconnection of the hose, tube, or other device to the air valve possible. The quick-connect assembly preferably includes a male connection end and a female connection end, one positioned on the air valve(s) and one positioned on the detachable connection means, wherein the male connection end employs an internal projection that slidably connects to and releases from a groove provided on the female connection end using lateral force. One or more o-rings may also be included on either or both connection ends to help ensure a sealed fit between the two connection ends.

The present invention operates in an easy-to-understand way to facilitate quick and easy set-up and removal of the playpen or play-yard product. To unpack the invention, the user removes the mattress surrounding the remaining components, including the collapsible frame assembly and the air compressor and hose/tube, in preferable embodiments, and lays the mattress flat on the ground, with the hard substrate layer adjacent to the ground and the foam pad arranged at the top of the mattress. The user then unpacks the collapsible frame assembly to set up the entertainment environment.

Preferable embodiments of the collapsible frame assembly include an outer frame, one or more base mattress supports, and one or more corner caps. The outer frame forms the perimeter of the entertainment environment, preferably including perimeter rails at both the top and bottom and corner posts connecting the top perimeter rails to the bottom perimeter rails. The perimeter rails preferably form a square or rectangular shape, with corner posts at each corner, but other shapes are also possible, as noted. The outer frame also preferably includes mesh, cloth, or other soft fabric walls spanning between the top and bottom perimeter rails and the corner posts to provide an entertainment environment enclosed on all (typically four) sides. The corner caps surround the connections of the corner posts to the top and bottom perimeter rails, preferably, to ensure there are no sharp edges on which a child could be harmed. The corner caps also help to lock the outer frame in place when the collapsible frame assembly is set up and in the unpacked position. The one or more base mattress supports span between the bottom perimeter rails and form a base for the mattress to rest on lying flat. In preferable embodiments including an air compressor, the air compressor is mounted to the collapsible frame assembly such that it is below the one or more base mattress supports when the collapsible frame assembly is in the unpacked position. In this way, a child within the entertainment environment cannot access the air compressor. While such an arrangement is preferable, it is not necessary to accomplish the objectives of the present invention. Indeed, those of ordinary skill in the art will recognize there may be instances where a design that permits access to the air compressor from within the entertainment environment is preferable, and the present invention is not limited to one arrangement or another.

Once the collapsible frame assembly is set up and locked into the unpacked position, the user can install the mattress. The mattress is sized to fit within the unpacked collapsible frame assembly and lie flat on the one or more base mattress supports of the collapsible frame assembly. In preferable embodiments including an air compressor and tube, hose, or other means of transferring air, the mattress can be connected to the air compressor through the air valve(s) to inflate the mattress once installed in the collapsible frame assembly. As will be understood to those of ordinary skill in the art, the mattress may alternatively be inflated before it is installed in the collapsible frame assembly and/or may be inflated using a pump or other means of providing air to the inflatable bladder. Such versatility allows a user to substitute the mattress of the present invention for those mattresses that are included with the typical playpen or play-yard products currently on the market.

To disassemble the playpen for transport and/or storage, the user removes the mattress from inside the collapsible frame assembly and deflates the inflatable bladder using the one or more air valves. The air valves are preferably positioned so as to facilitate quick deflation of the mattress, for example through folding the hard substrate later placing pressure on the inflatable bladder to assist in expelling air. Once the inflatable bladder is fully deflated, the mattress can be used to enclose and carry the remaining components of the playpen, including the collapsible frame assembly, once again. The user then disassembles the collapsible frame assembly and uses the deflated mattress to enclose the remaining components for easy and convenient transport and/or storage. In some cases, the entire playpen or play-yard product, including mattress, collapsible frame assembly, etc., can then be placed into a carrying case.

As those skilled in the art will appreciate, the present invention is not limited to the embodiments and arrangements described above. Other objects of the present invention and its particular features and advantages will become more apparent from consideration of the following drawings and detailed description of the invention.

DETAILED DESCRIPTION OF THE INVENTION

The following detailed description illustrates the technology by way of example, not by way of limitation of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter.

Figure 1A:
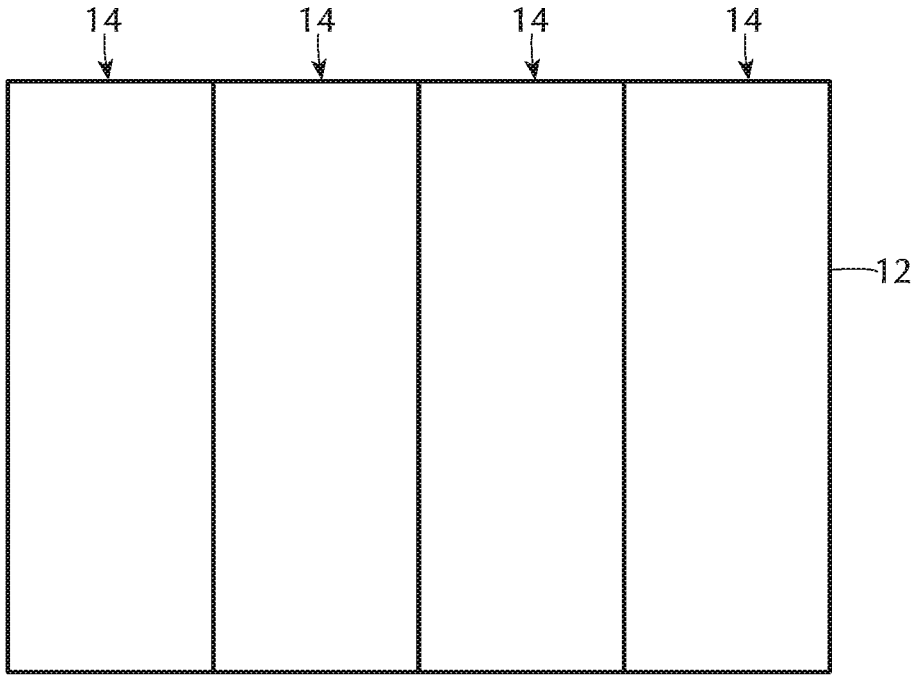
FIG. 1A illustrates a cross-sectional plan view from the top of a mattress for a children's playpen or play-yard product according to exemplary embodiments of the present invention and depicts a hard substrate layer with four rigid substrate sections.

Referring first to FIG. 1, a mattress 10 for a children's transportable playpen or play-yard product 5 is depicted exemplifying embodiments of the present technology. The mattress 10 includes a hard substrate layer 12 made up of several rigid substrate sections 14. Preferable embodiments include four rigid substrate sections 14, as depicted in FIG. 1A, but other embodiments may include more or less than 4 rigid substrate sections 14, as will be understood by those of ordinary skill in the art. The hard substrate layer 12 is adapted to lie flat and sized to fit within the collapsible frame assembly 42 of the children's playpen or play-yard product 5 when in the unpacked position, as depicted in FIG. 1A. The hard substrate layer 12 is also adapted to fold up into a carrying case to surround and enclose the other components of the playpen or play-yard product 5 when in the storage and/or transport position. Accordingly, the rigid substrate sections 14 of the hard substrate layer 12 are movably connected to one another such that they can lie flat adjacently or fold into a multisided shape, such as a square, rectangle, or other quadrilateral or multilateral shape. The rigid substrate sections 14 are preferably composed of a hard material, such as wood or plastic. Those of ordinary skill in the art will recognize the various material options available for the rigid substrate sections 14.

Figure 1B:
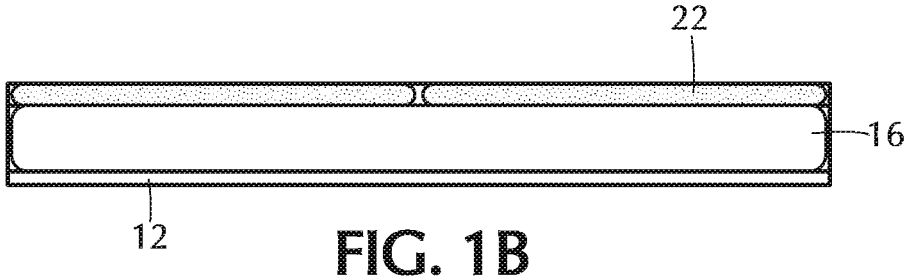
FIG. 1B illustrates a cross-sectional view from the side of the mattress for a children's playpen or play-yard product according to the exemplary embodiments of the present invention depicted in FIG. 1A, including a foam pad, an inflatable bladder when deflated, a hard substrate layer, and an expandable fabric.
Figure 1C:
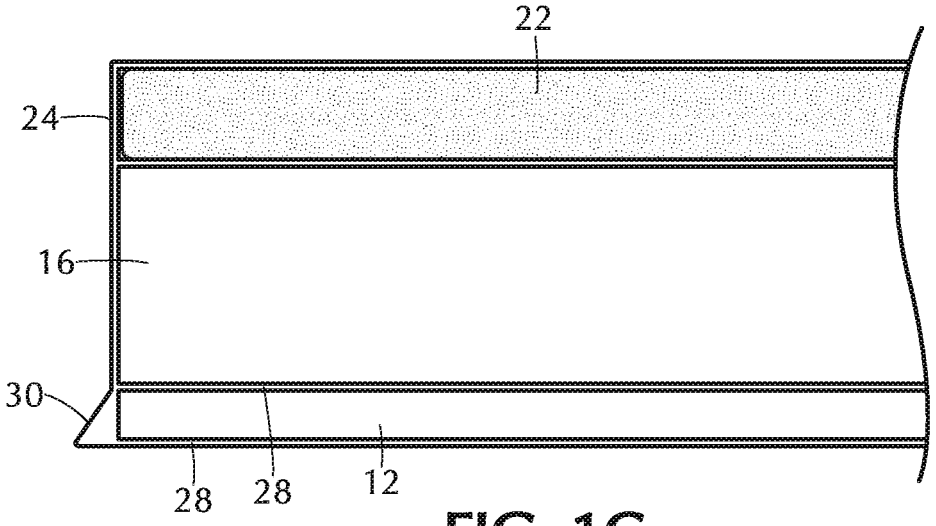
FIG. 1C illustrates a partial, cross-sectional view from the side of the mattress for a children's playpen or play-yard product according to the exemplary embodiments of the present invention depicted in FIGS. 1A-1B, including a foam pad, an inflatable bladder when deflated, a hard substrate layer, and an expandable fabric.

The mattress 10 depicted in FIG. 1 also includes an inflatable bladder 16, as shown in FIGS. 1B and 1C. The inflatable bladder 16 operates to add cushioning and improve comfort when inflated but does not hinder the mattress's 10 ability to operate as a carrying case for the playpen or play-yard product 5 when deflated. To permit inflation and deflation, the inflatable bladder 16 includes one or more air chambers 18 accessible via one or more air valves 20. Some embodiments may include an air valve 20 for each air chamber 18 while other embodiments may include a single air valve 20 capable of inflating and deflating all air chambers 18 included in the inflatable bladder 16. The air valve or valves 20 are preferably easily accessible from the outside of the mattress 10, allowing a user to connect an air source for inflation and to access an air release mechanism for deflation. Those of ordinary skill in the art will recognize the various techniques and devices available for inflating and deflating the inflatable bladder, such as an air compressor, hand pump, release valve, etc.

The mattress 10 with the inflatable bladder 16 achieves certain objectives of the present invention by improving comfort when inflated and installed but remaining bendable when deflated so as not to hinder the mattress's 10 ability to operate as a carrying case. When installed the mattress 10 lies flat with the inflatable bladder 16 above the hard substrate layer 12. The hard substrate layer 12 provides a solid base for the mattress 10 to rest upon the playpen's frame when set up. The inflatable bladder 16 can be inflated to provide a soft, cushion-like upper portion for the child to stand/sit/lay on. In some preferable embodiments, the mattress 10 also includes one or more foam pads 22 above the inflatable bladder 16, adding additional support and comfort. In such embodiments, the inflatable bladder 16 is preferably disposed between the hard substrate layer 12 and the foam pad 22, and the foam pad 22 provides a comfortable top layer with the inflatable bladder 16 adding additional comfort when inflated. Indeed, in some instances the user may choose not to inflate the inflatable bladder 16 even when the mattress 10 is installed, for example if the child will only be in the playpen environment for a short period of time and the foam pad 22 will provide sufficient comfort and support. The one or more foam pads 22 may also be located between the inflatable bladder 16 and the hard substrate layer 12 or otherwise arranged. Those of ordinary skill in the art will appreciate the flexibility the mattress 10 of the present invention provides.

As shown in FIG. 1, preferable embodiments of the mattress 10 are sized so as to fit snuggly within the frame of a playpen or play-yard product once it is set up while also providing sufficient thickness and comfort for a child playing within. Accordingly, preferable embodiments of the mattress 10 have an overall width around twenty-six inches and an overall length of about thirty-six inches. Furthermore, preferable embodiments of the mattress's inflatable bladder 16 have a thickness of about 1.25 inches (when in a deflated state) and preferable embodiments of the hard substrate layer 12 have a thickness of about 0.25 inches. And in those preferable embodiments of the mattress 10 that also employ one or more foam pads 22, the foam pads' 22 thickness is preferably about 0.5 inches.

Figure 8:
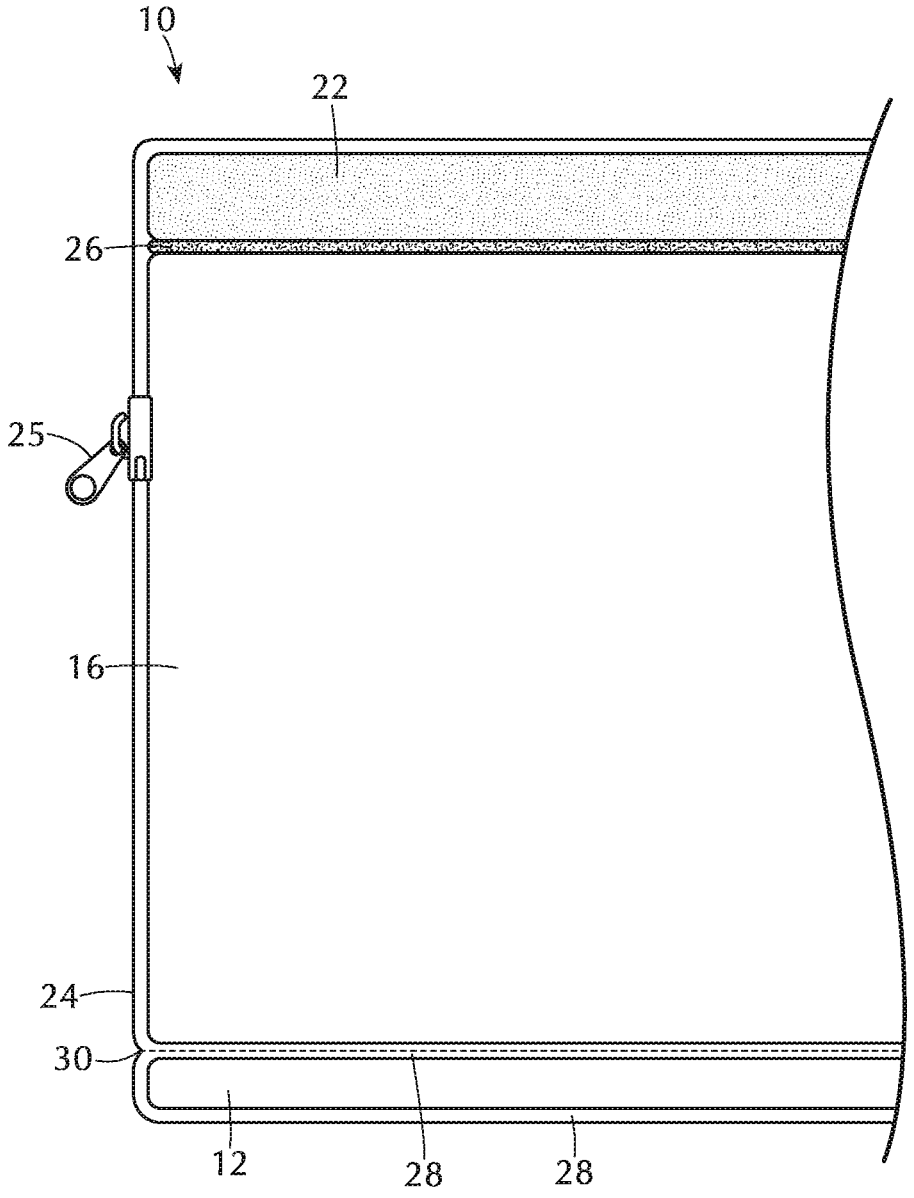
FIG. 8 illustrates a partial, cross-sectional view from the side of the mattress for a children's playpen or play-yard product according to the exemplary embodiments of the present invention depicted in FIGS. 1-7, including a foam pad, an inflatable bladder when inflated, a hard substrate layer, and an expandable fabric.

When inflated, as depicted in FIG. 8, preferable embodiments of the mattress's inflatable bladder 16 have an increased thickness of about 4 inches. Such preferable embodiments of the mattress 10 accordingly increase from a total thickness (including hard substrate layer 12, inflatable bladder 16, and foam pad(s) 22) of about 2 inches when the inflatable bladder 16 is deflated to a total thickness (including hard substrate layer 12, inflatable bladder 16, and foam pad(s) 22) of about 4.75 inches when the inflatable bladder 16 is inflated, as depicted in FIGS. 1B-C and 8, respectively. This increased thickness makes the playpen more comfortable for a child playing within, accomplishing certain objectives of the present invention.

Preferable embodiments of the mattress 10 further employ an expandable fabric 24, as depicted in FIGS. 1C and 8. Those of ordinary skill in the art will recognize the various ways to employ the expandable fabric 24 to prevent the different layers of the mattress 10 (hard substrate layer 12, inflatable bladder 16, foam pad(s) 22) from becoming displaced relative to one another. In certain embodiments, for example, the expandable fabric 24 may simply envelop the components of the mattress 10 to keep them together. In other preferable embodiments, the expandable fabric 24 may also include layers between the components of the mattress 10, as depicted in FIG. 1C. For example, layers of expandable fabric 24 may surround each of the hard substrate layer 12, inflatable bladder 16, and one or more foam pads 22, in some embodiments. In such embodiments, the expandable fabric 24 forms pouches containing each of the hard substrate layer 12, the inflatable bladder 16, and the foam pad(s) 22 where used. Additional components, such as a non-slip sheet 26, may be employed between or amongst the different layers of the mattress 10 as well to further prevent any relative displacement, as depicted exemplarily in FIGS. 1C and 8.

In some preferable embodiments, the expandable fabric 24 may also be used to connect the rigid substrate sections 14 of the hard substrate layer 12 to one another. In such embodiments, the elasticity of the expandable fabric 24 would facilitate the folding of the hard substrate layer 12 when the mattress 10 is in use as a carrying case in the storage/transport position. And the pouches formed by the expandable fabric 24 containing each of the rigid substrate sections 14 ensure the rigid substrate sections 14 stay in place and adjacent to one another when the mattress 10 is lying flat. As depicted in FIGS. 1C and 8, the expandable fabric 24 may comprise one or more sections of base layer fabric 28, which may be of similar material as the other portions of the expandable fabric 24 and/or may be of more rigid material to more reliably hold the rigid substrate sections 14 of the hard substrate layer 12 in place and adjacent to one another. Those of ordinary skill in the art will recognize the various arrangements and materials available for the expandable fabric components.

As depicted in FIG. 1C, some embodiments of the present invention further comprise one or more stitches 30 in the expandable fabric 24 connecting the expandable fabric 24 to the base layer fabric 28, where used, and/or directly to the inflatable bladder 16 and/or foam pad(s) 22, where used. Such stitching 30 further helps to hold the various mattress 10 components in place. The expandable fabric 24 also preferably has slots in alignment with the air valve or valves 20 used to inflate and deflate the inflatable bladder 16, facilitating easy access to the air valve(s) 20. Stitching 30 may be used to ensure the slots in the expandable fabric 24 remain aligned with the air valves 20 of the inflatable bladder 16. Those of ordinary skill in the art will recognize the variety of materials capable of performing the functions required of the expandable fabric 24, any of which can be used with the present invention.

Figure 2A:
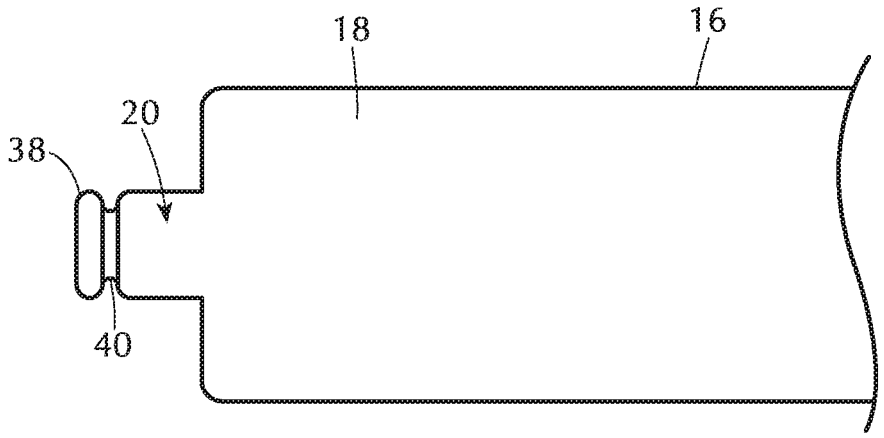
FIG. 2A illustrates a partial cross-sectional view from the side of the inflatable bladder of the mattress for a children's playpen or play-yard product according to the exemplary embodiments of the present invention depicted in FIG. 1, including an exemplary air chamber and air valve.
Figure 2B:
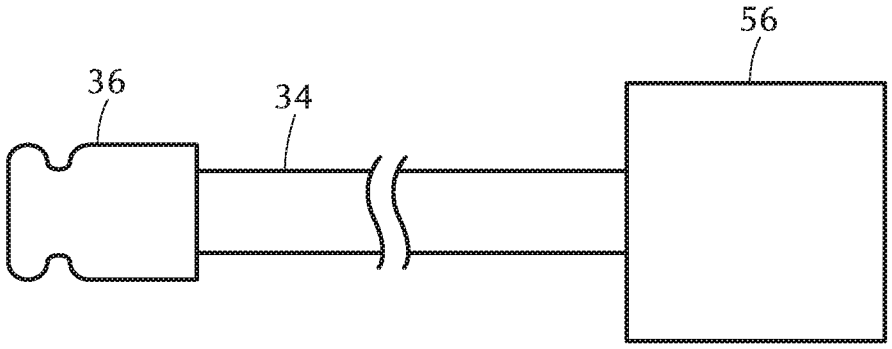
FIG. 2B illustrates a perspective view of an air compressor and means for inflating the mattress for a children's playpen or play-yard product according to the exemplary embodiments of the present invention depicted in FIGS. 1 and 2A.

Referring next to FIG. 2A, an exemplary embodiment of the inflatable bladder 16 and accompanying air valve is depicted 20. As depicted, the air valve 20 preferably projects from the side of the inflatable bladder 16 and preferably employs a quick-connect assembly to facilitate rapid connection and disconnection from known air supply devices. The air valve 20 also preferably has rapid air release functionality, the techniques and designs for which will be known to those of ordinary skill in the art. Likewise, as depicted in FIG. 2B, preferable embodiments of the present invention employ an air source 56, such as an air compressor, hand or foot pump, etc., and a plastic air delivery tube 34 also employing the quick-connect assembly. Those of ordinary skill in the art will recognize the various alternative arrangements possible for the air valve 20 and inflating/deflating the inflatable bladder 16.

For preferable embodiments employing the quick-connect assembly, the assembly preferably allows the plastic air delivery tube 34 and the air valve 20 to connect via a quick-release, male/female connector. The male connection end 36 is on the plastic air delivery hose 34 and the female connection end 38 is on the air valve 20 in the embodiment depicted in FIG. 2B, but the components can also be reversed, with the male end 36 on the air valve 20 and the female end 38 on the plastic air hose 34. The quick-connect assembly operates by including an internal projection within the male connection end 36 that slides into place seated in a groove 40 provided on the female connection end 38. The groove 40 and internal projection slidably connect and release using lateral force relative to one another. Preferable embodiments also include o-rings, disposed on the inside of the male connection end 36, on the outside of the female connection end 38, or both, to provide a sealed fit between the two connection ends. Those of ordinary skill in the art will recognize and understand the components and operation of the quick-connect assembly, which is not limited to the arrangement and operation described.

Some embodiments of the present invention may forego the quick-connect assembly altogether and instead employ other known techniques for connecting the plastic air delivery hose 34 and air valve 20, such as a screwing connection assembly. Some embodiments may also combine the quick-connect assembly with other known techniques. Those of ordinary skill in the art will recognize the various options available for connecting the air valve 20 and plastic air hose 34 to facilitate inflation and deflation of the inflatable bladder 16.

Figure 3:
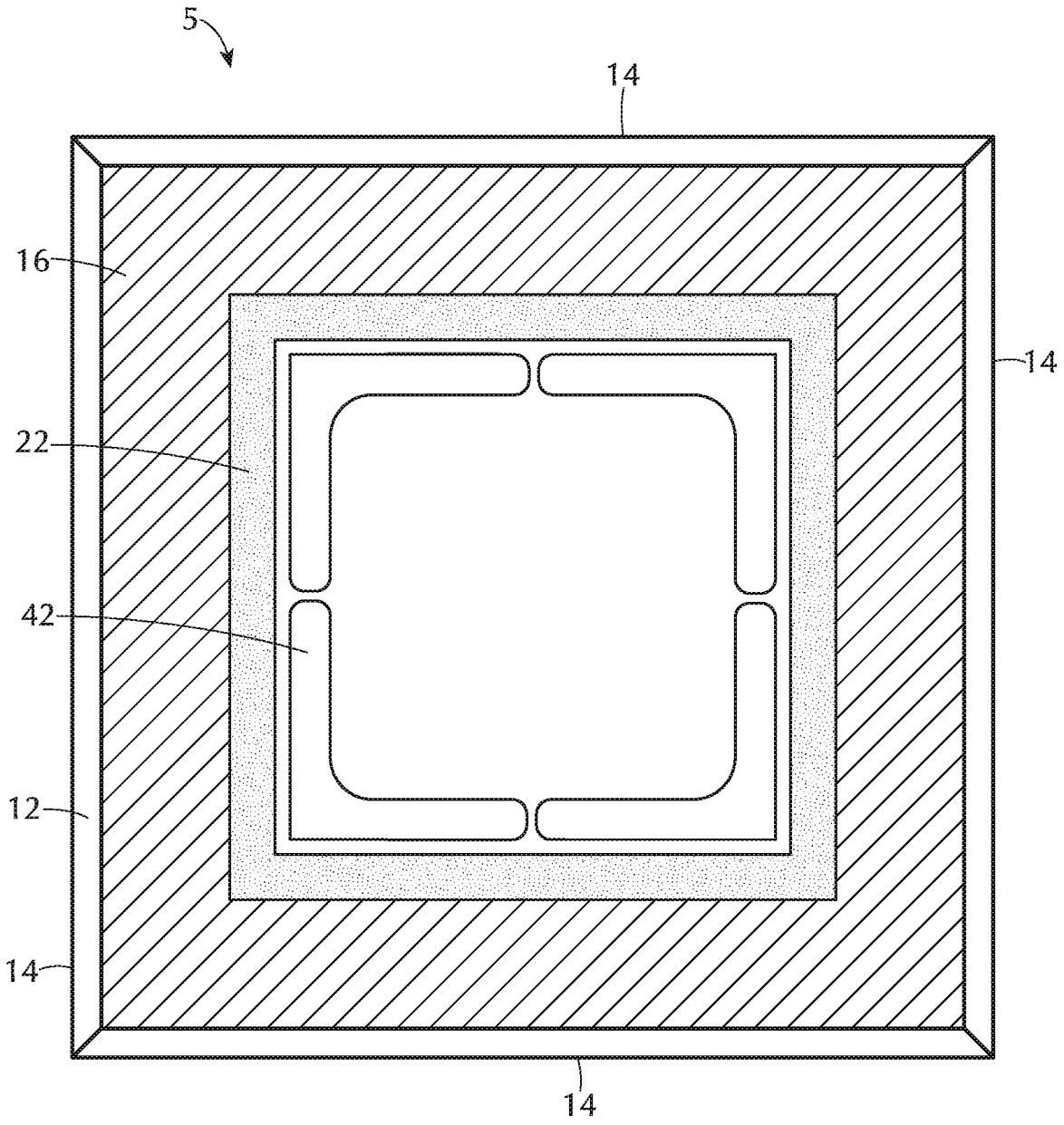
FIG. 3 illustrates a cross-sectional view from the top of the children's playpen or play-yard product in its storage and/or transport position according to the exemplary embodiments of the present invention depicted in FIGS. 1-2, including the foam pad, inflatable bladder, and hard substrate layer of the mattress for a children's playpen or play-yard product according to the exemplary embodiments of the present invention depicted in FIGS. 1-2.

Referring next to FIG. 3, depicted is the children's playpen or play-yard product 5 in its storage/transport position. As depicted, the mattress 10 is in use to enclose the remaining components to facilitate convenient transportation and/or storage. The mattress's inflatable bladder 16 is preferably deflated when the mattress 10 is in its storage/transport position, as depicted in FIG. 3. Also included in the preferable embodiment depicted in FIG. 3 are the hard substrate layer 12 and its four rigid substrate sections 14 as well as the foam pad(s) 22. As depicted, the playpen's collapsible frame assembly 42 and other components, including the corner covers 50, air compression unit 56 (in preferable embodiments), etc., are contained by the mattress 10 when in the storage/transport position.

Figure 4:
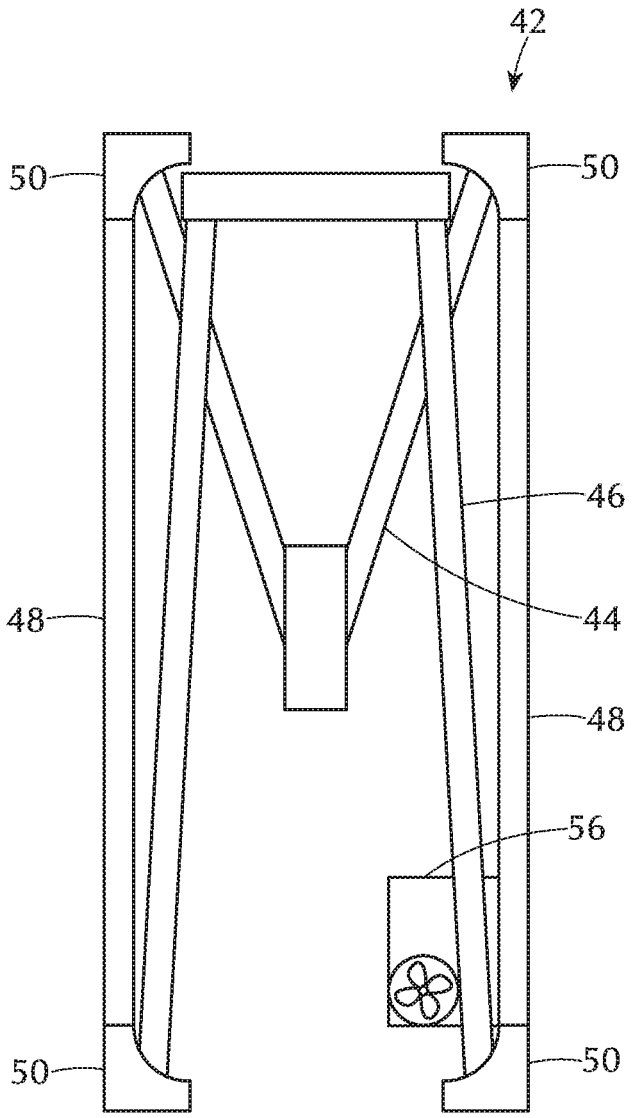
FIG. 4 illustrates a cross-sectional view from the side of the children's playpen or play-yard product in its storage and/or transport position according to the exemplary embodiments of the present invention depicted in FIGS. 1-3, including the collapsible frame assembly and air compressor.

FIG. 4 depicts the children's playpen or play-yard product 5 in the storage/transport position as well. In FIG. 4, the mattress 10 surrounding the collapsible frame assembly 42 has been removed, and the collapsible frame assembly 42 is depicted in its collapsed state—the storage/transport position. As indicated in FIG. 4, preferable embodiments of the collapsible frame assembly 42 measure approximately 26×8.5×8.5 inches in the storage/transport position, though other measurements, shapes, and arrangements of the collapsible frame assembly 42 are possible and will be apparent to those of ordinary skill in the art. The preferable embodiment of the collapsible frame assembly 42 depicted in FIG. 4 includes upper crossbars that open to become top perimeter rails 44, lower crossbars that open to become bottom perimeter rails 46, vertical corner posts 48 connecting the top and bottom perimeter rails 44, 46, and corner covers 50 at the positions where the top and bottom perimeter rails 44, 46 and vertical corner posts 48 meet. Such preferable embodiments also include base mattress supports 52 that span between the lower crossbars that form the bottom perimeter rails 46; the mattress 10 rests on the base mattress supports 52 when installed within the collapsible frame assembly 42 in its unpacked position.

The top and bottom perimeter rails 44, 46 form an outer frame for the entertainment environment when the collapsible frame assembly 42 is in the unpacked position. To fully enclose the entertainment environment, preferable embodiments include mesh fabric 54 spanning between the top and bottom perimeter rails 44, 46. A soft mesh fabric 54 is preferable so as to avoid injury to a child playing within, though other designs and materials will be readily apparent to those of ordinary skill in the art.

As depicted in FIG. 4, preferable embodiments of the invention also include an air compressor 56 mounted to the collapsible frame assembly 42. The air compressor 56 is preferably mounted to the collapsible frame assembly 42 in a location that is inaccessible from within the entertainment environment when the collapsible frame assembly 42 is in its unpacked and set-up position and the mattress 10 is installed. For example, the air compressor 56 may be mounted to the underside of one of the base mattress supports 52 or may be mounted to the underside of one of the lower crossbars that expand to form the bottom perimeter rails 46. Alternatively, the air compressor 56 may be mounted to the side of a vertical corner post 48 at a position below the base mattress supports 52. Those of ordinary skill in the art will recognize the various ways of mounting the air compressor 56 so as to make it inaccessible from within the entertainment environment, all of which are options available to accomplish the objectives of the present invention. The air compressor 56 also preferably includes means for attaching the air compressor 56 to the air valve 20 of the mattress's inflatable bladder 16, in the form of a plastic air tube 34 or otherwise, as depicted in FIG. 2B. And said means also preferably employs the quick-connect assembly described above to facilitate easy inflation of the mattress's inflatable bladder 16.

Figure 5:
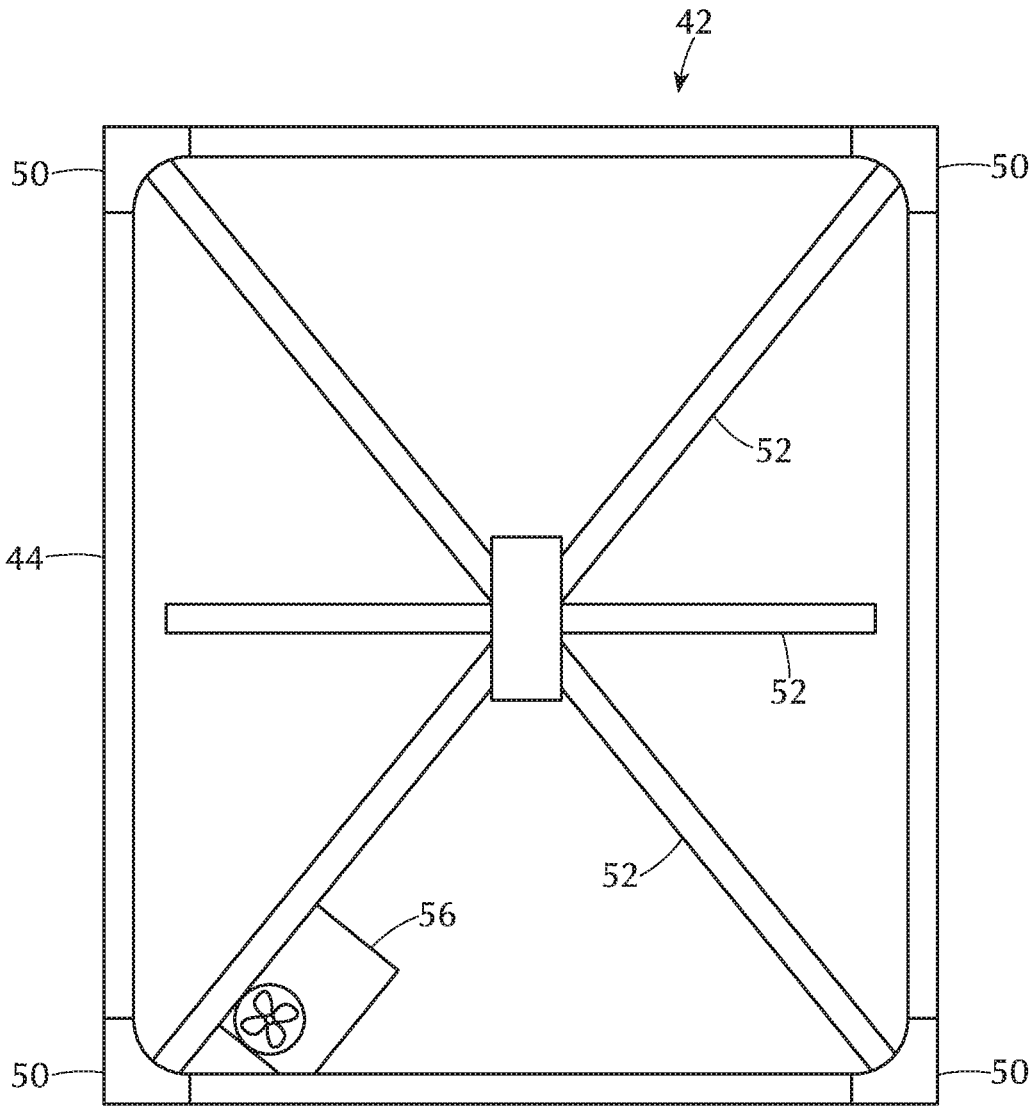
FIG. 5 illustrates a perspective view from the top of the children's playpen or play-yard product in its unpacked position according to the exemplary embodiments of the present invention depicted in FIGS. 1-4, including the collapsible frame assembly and air compressor.

Referring now to FIG. 5, the collapsible frame assembly 42 is depicted in its unpacked and set-up position. As shown, the top and bottom perimeter rails 44, 46 are locked into position to form the outer frame, the connection of the vertical corner posts 48 to the top and bottom perimeter rails 44, 46 are covered by the corner covers 50 for safety, and the base mattress supports 52 span between the bottom perimeter rails 46 to support the mattress 10, which is not depicted in FIG. 5. In the preferable embodiment depicted in FIG. 5, the air compressor 56 is mounted to one of the base mattress supports 52 such that it will be covered and inaccessible from within the entertainment environment once the mattress 10 is installed to form the entertainment environment's floor. As noted, the air compressor 56 may be mounted in other locations to achieve the same effect, as will be recognized by those of ordinary skill in the art. The mattress 10 is preferably sized so as to fit snugly within the collapsible frame assembly 42 when in its unpacked and set-up position.

Figure 6:
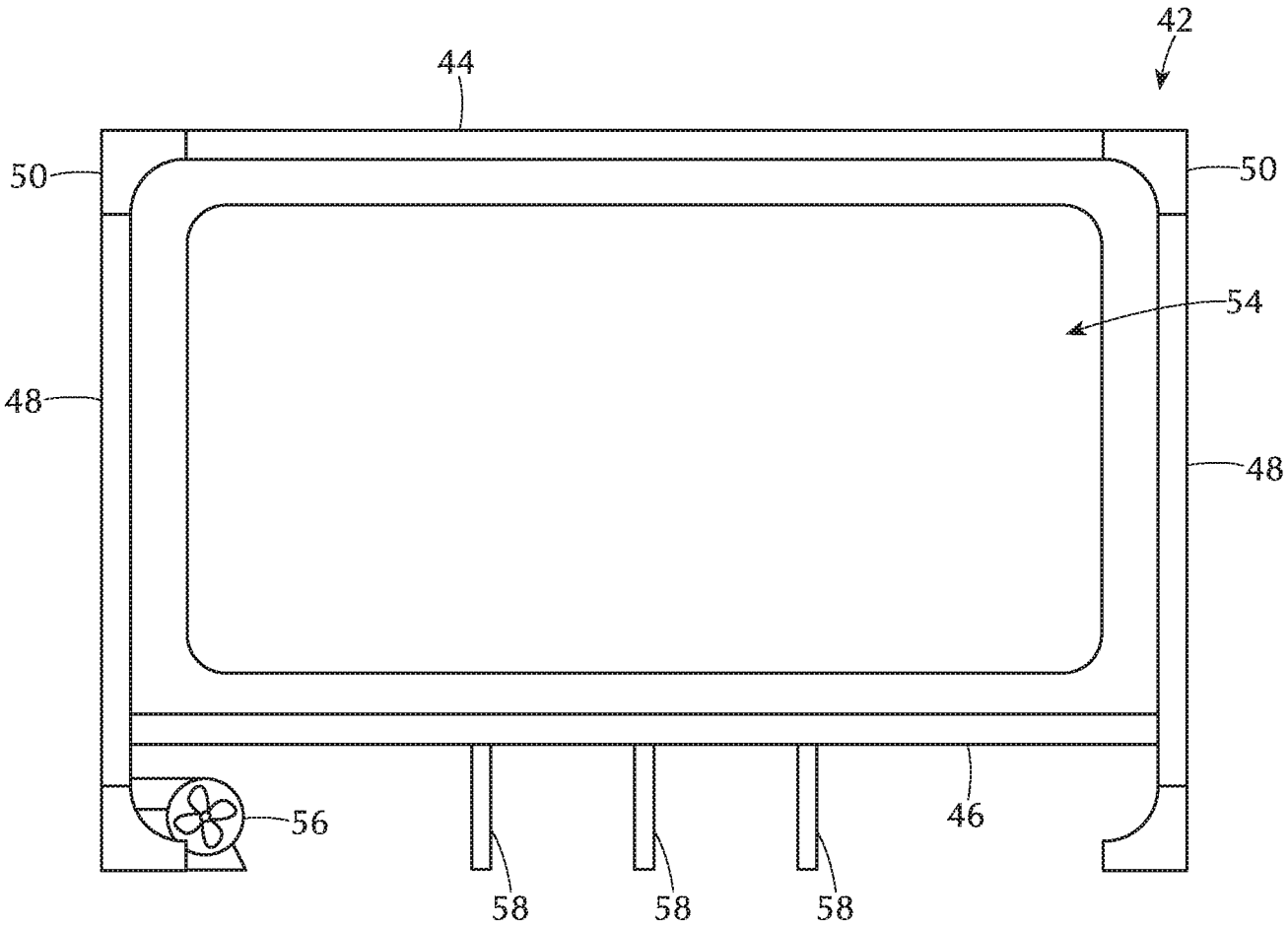
FIG. 6 illustrates a perspective view from the side of the children's playpen or play-yard product in its unpacked position according to the exemplary embodiments of the present invention depicted in FIGS. 1-5, including the collapsible frame assembly and air compressor.
Figure 7:
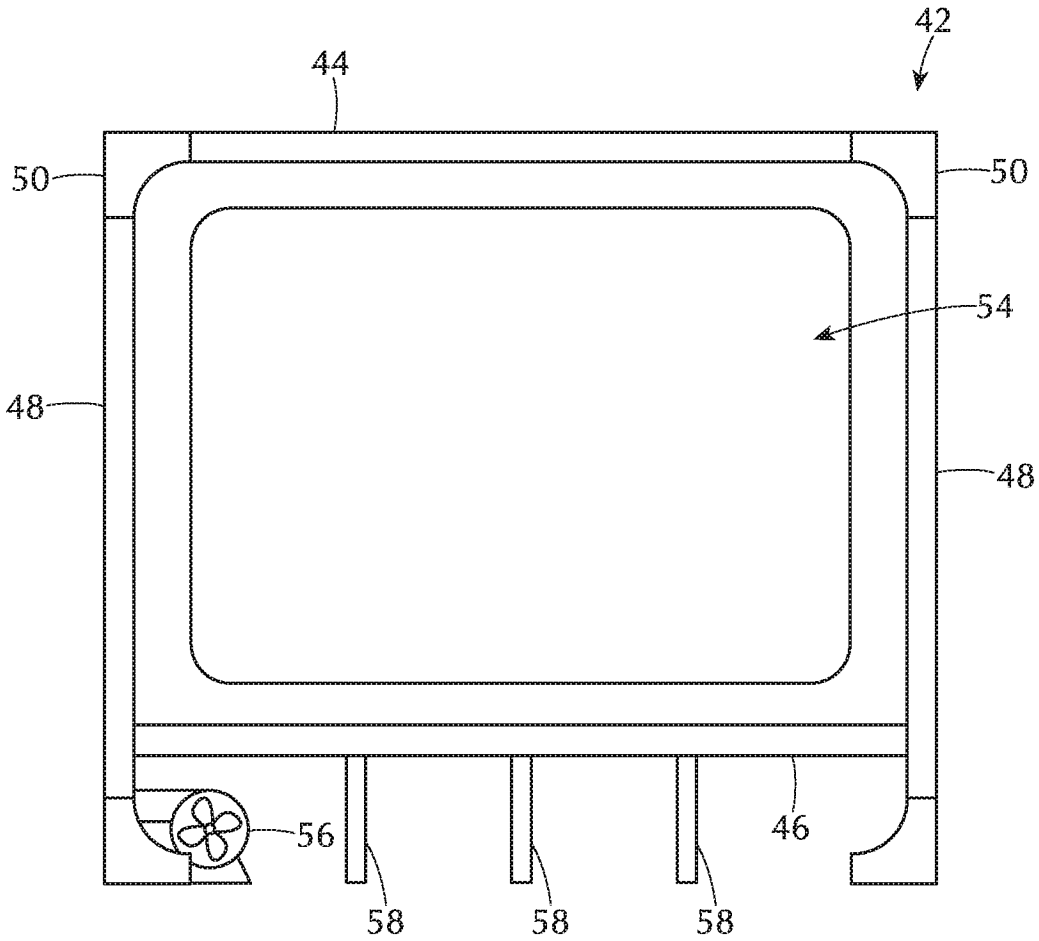
FIG. 7 illustrates a perspective view from the side of the children's playpen or play-yard product in its unpacked position according to the exemplary embodiments of the present invention depicted in FIGS. 1-6, including the collapsible frame assembly and air compressor.

Referring next to FIGS. 6-7, the children's playpen or play-yard product 5 is again depicted in its unpacked position, with the collapsible frame assembly 42 set up and locked into position. FIGS. 6-7 show preferable embodiments with mesh fabric walls 54 spanning between the depicted vertical corner posts 48 and the top and bottom perimeter rails 44, 46. As noted, other designs for creating a fully enclosed entertainment environment are also available, as will be recognized by those of ordinary skill in the art, but the mesh fabric wall 54 is preferable to reduce any potential safety hazards. In the preferable embodiment depicted in FIGS. 6-7, the air compressor 56 is mounted to one of the vertical corner posts 48 at a position below the base mattress supports 52. This arrangement ensures the air compressor 56 is inaccessible from within the entertainment environment when the mattress 10 is installed. Also depicted in FIGS. 6-7 are vertical legs 58 supporting the base mattress supports 52, a preferable embodiment. These vertical legs 58 help stabilize the base mattress supports 52 and the mattress 10 resting thereon, which may be useful for older and heavier children using the playpen 5.

Figure 9:
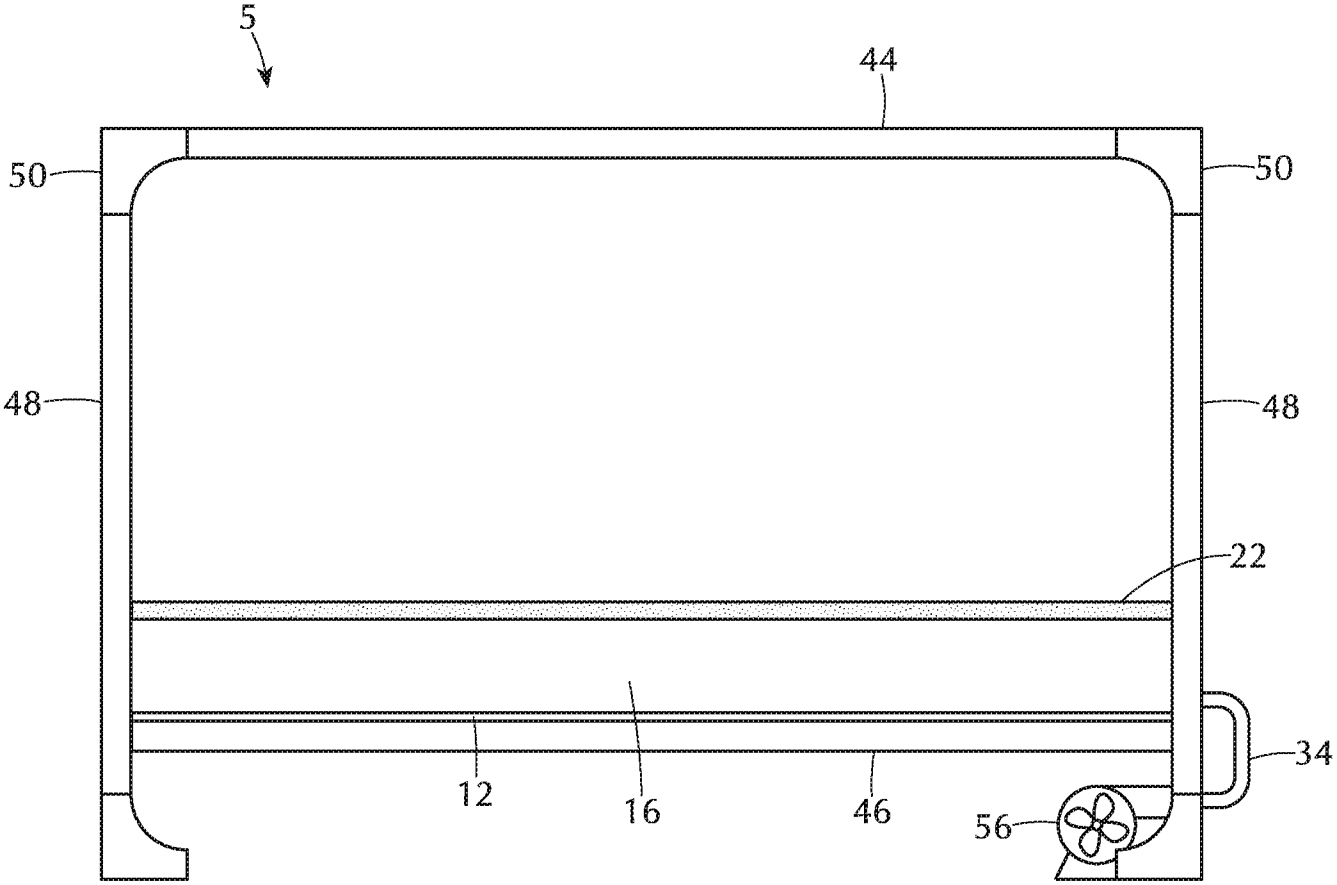
FIG. 9 illustrates a perspective view from the side of the children's playpen or play-yard product in its unpacked position and with the mattress inflated and installed according to the exemplary embodiments of the present invention depicted in FIGS. 1-8.
Figure 10:
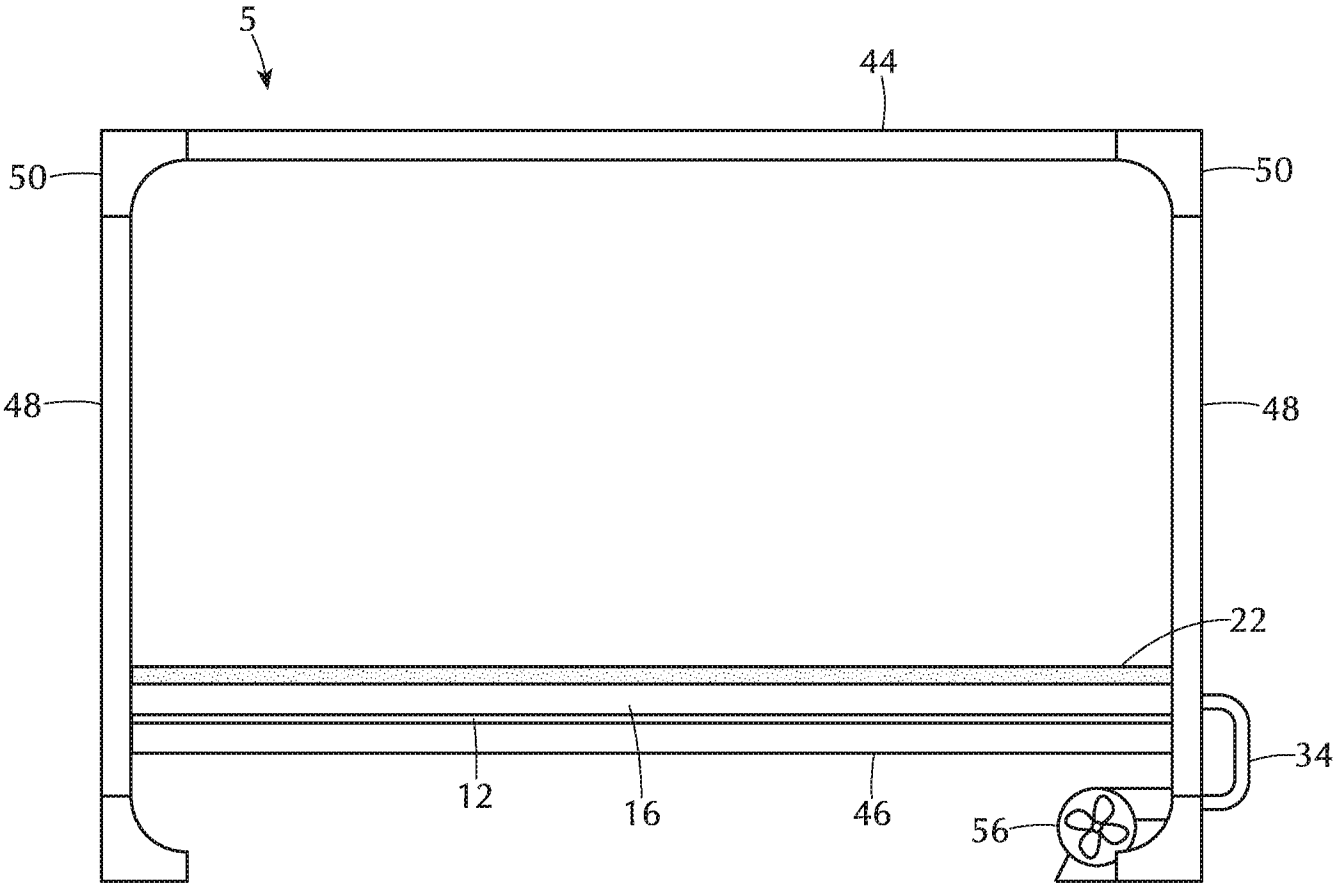
FIG. 10 illustrates a perspective view from the side of the children's playpen or play-yard product in its unpacked position and with the mattress inflated and installed according to the exemplary embodiments of the present invention depicted in FIGS. 1-9.

Referring now to FIGS. 9-10, an embodiment of the playpen or play-yard product 5 is depicted with the collapsible frame assembly 42 in its unpacked and set-up position and with the mattress 10 installed. The preferable embodiment of the mattress 10 depicted in FIGS. 9-10 shows the hard substrate layer 12, inflatable bladder 16, and one or more foam pads 22, preferably encased by the expandable fabric 24, as described. FIG. 9 depicts a preferable embodiment in which the inflatable bladder 16 is fully inflated and the mattress 10 is approximately 4.75 inches thick. FIG. 10 depicts a preferable embodiment in which the inflatable bladder 16 is fully deflated and the mattress 10 is approximately 2 inches thick. Both FIGS. 9-10 depict a preferable embodiment employing an air compressor 56 attached to the collapsible frame assembly 42. As depicted, the air compressor 56 in such preferable embodiments is preferably positioned to be inaccessible from within the entertainment environment, thereby avoiding any potential hazard to a child playing within and accomplishing certain objectives of the present invention. Also depicted in FIGS. 9-10 is a plastic air delivery hose 34, employed in preferable embodiments of the present invention, which is also preferably positioned to be inaccessible from within the entertainment environment.

Figure 11A:
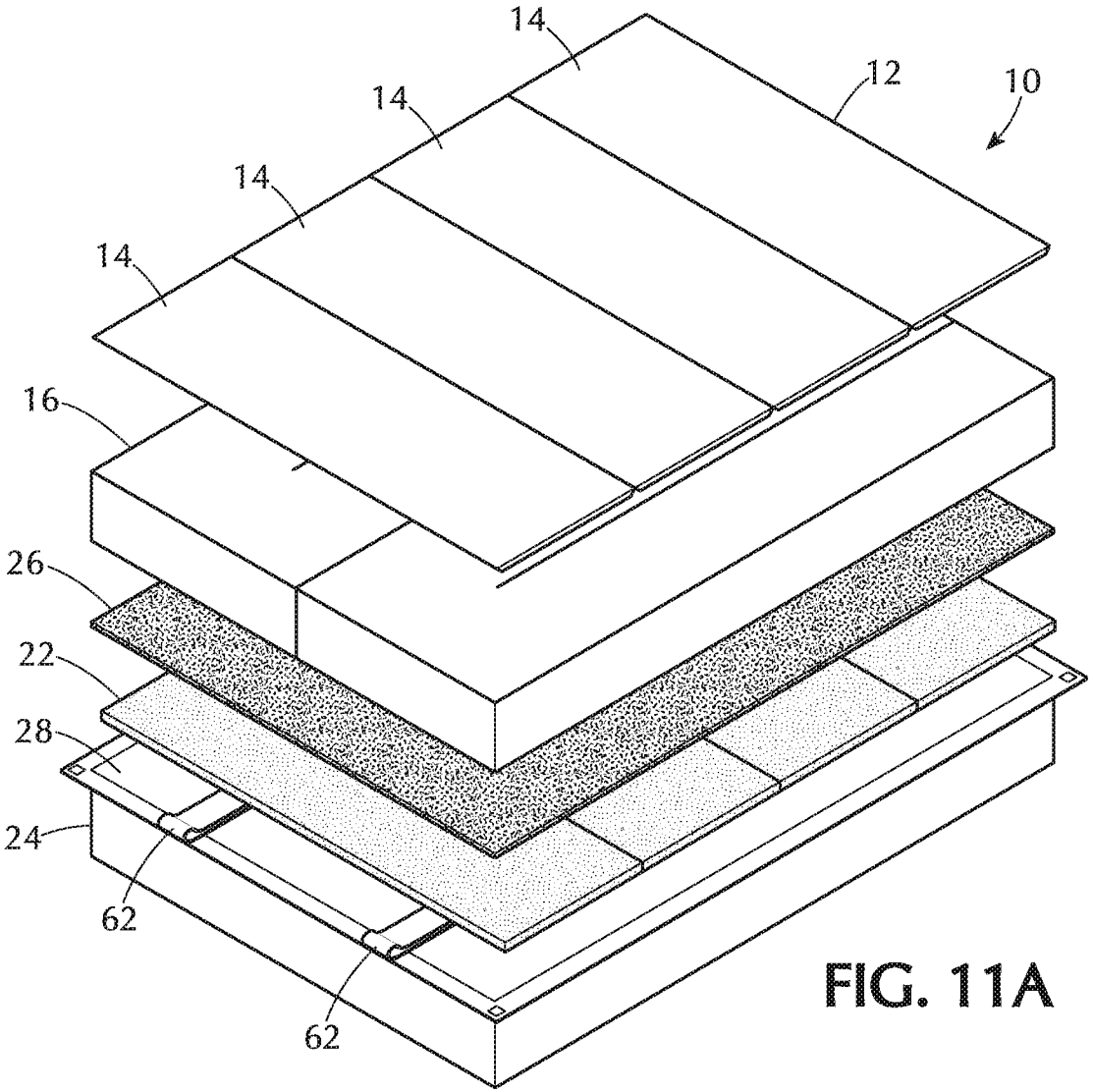
FIG. 11A illustrates an exploded view of the mattress for a children's playpen or play-yard product according to the exemplary embodiments of the present invention depicted in FIGS. 1-10, including an opaque depiction of a foam pad, a non-slip sheet, an inflatable bladder, a hard substrate layer, a base layer fabric, and an expandable fabric.
Figure 11B:
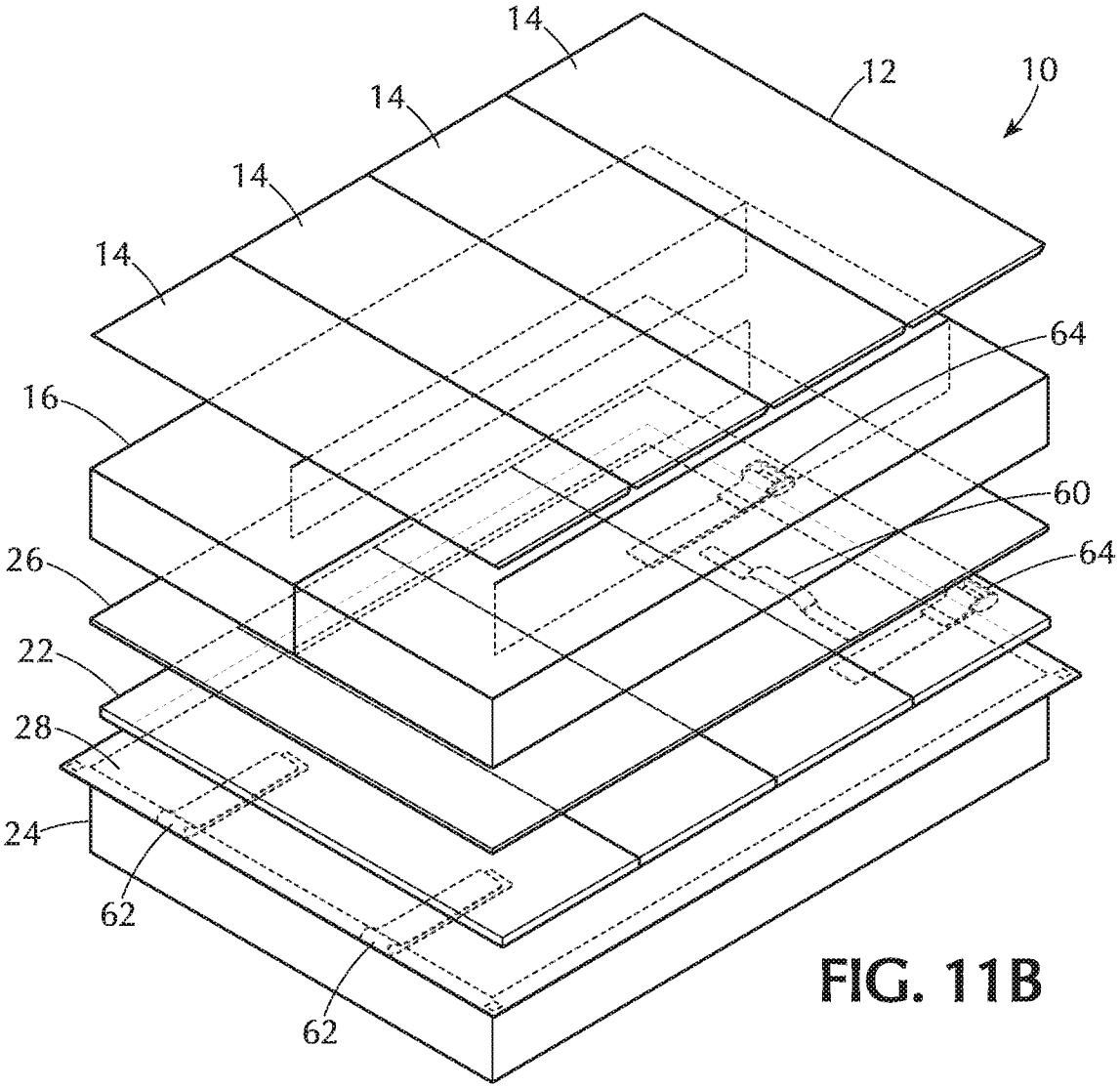
FIG. 11B illustrates an exploded view of the mattress for a children's playpen or play-yard product according to the exemplary embodiments of the present invention depicted in FIGS. 1-10, including a translucent depiction of a foam pad, a non-slip sheet, an inflatable bladder, a hard substrate layer, a base layer fabric, and an expandable fabric.

Referring next to FIGS. 11A and 11B, depicted is an exploded view of a preferable embodiment of the mattress 10 of the present invention. The depicted preferable embodiment of the mattress 10 includes a hard substrate layer 12 made up of several rigid substrate sections 14, an inflatable bladder 16, one or more foam pads 22, a non-slip sheet 26 arranged between the inflatable bladder 16 and the one or more foam pads 22, a base layer fabric 28, and an expandable fabric 24. Noting that the mattress 10 depicted in FIGS. 11A-11B is inverted, the exploded view illustrates a preferable arrangement of the mattress 10 components, whereby expandable fabric 24 encloses the other mattress 10 components, with the base layer fabric 28 below (and in some preferable embodiments surrounding) the hard substrate layer 12, followed in ascending order by the inflatable bladder 16, the non-slip sheet 26, and then the one or more foam pads 22, with the expandable fabric 24 wrapping around the top of the foam pad(s) 22 to form the top surface of the mattress 10, upon which the child would sit, stand, or lay when the mattress 10 is installed in the collapsible frame assembly 42.

Some preferable embodiments of the mattress's expandable fabric 24 also include a zipper or other comparable fastener 25, as depicted in FIG. 8. The fastener 25 preferably extend laterally around the four sides of the mattress 10. Such embodiments operate similar to expansion pockets in luggage, whereby the fastener 25 can be disconnected to allow for additional expansion of the expandable fabric 24 in a vertical direction when the mattress 10 is lying flat. As those of skill in the art will recognize, in the preferable embodiments of the mattress 10 with the fastener 25, the expandable fabric 24 folds over itself when the fastener 25 is connected, and the folds of the expandable fabric 24 extend fully to permit additional expansion space when the fastener 25 is disconnected. This added functionality allows the expandable fabric 24 to expand and contract more effectively to snugly fit over the mattress 10. For example, when the mattress 10 is in the unpacked position and the inflatable bladder 16 is fully inflated, the fastener 25 may be disconnected to permit the expandable fabric 24 to stretch further to encompass the entire mattress 10. Likewise, when the mattress 10 is in the storage/transport position and the inflatable bladder 16 is fully deflated, the fastener 25 may be connected to reduce the expansion of the expandable fabric 24 so that it fits snugly around the deflated mattress 10.

Some preferable embodiments of the mattress 10 further include one or more carrying straps 60 and fastening means, for example in the form of sets of hook-and-loop fastener (e.g. VELCRO® brand fastener) straps 62 and strap loops 64, as depicted in FIGS. 11A-B. The one or more carrying straps 60 and fastening means 62, 64 are preferably attached to the base layer fabric 28 so as to provide convenient access when the mattress 10 is in the storage/transport position. In embodiments that do not employ the base layer fabric 28, the carrying straps 60 and fastening means 62, 64 are preferably attached to the expandable fabric 24, again providing easy access when the mattress 10 is in the storage/transport position. Those of ordinary skill in the art will recognize the various means for attaching the carrying straps 60 and fastening means 62, 64 to the base layer fabric 28 or the expandable fabric 24, for example by sewing, etc. The carrying straps 60 and fastening means 62, 64 may also be formed directly into the base layer fabric 28 or the expandable fabric 24.

Figure 14A:
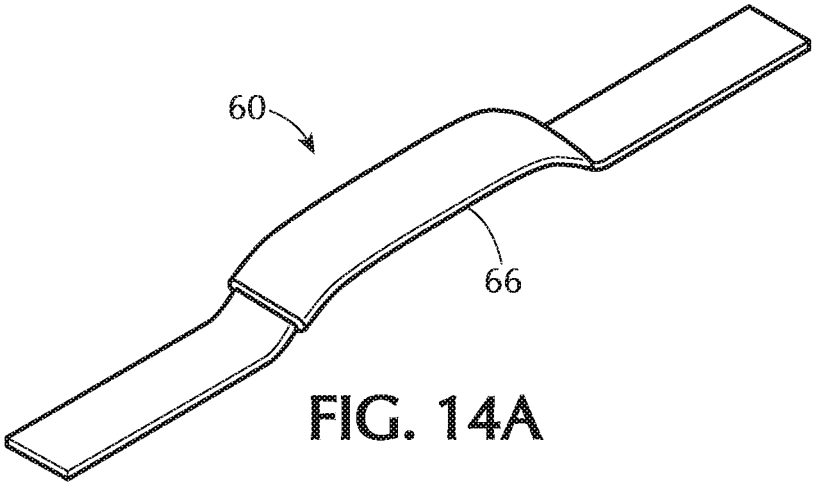
FIG. 14A illustrates an isometric view of a carrying strap according to exemplary embodiments of the present invention depicted in FIGS. 1-13.
Figure 14B:
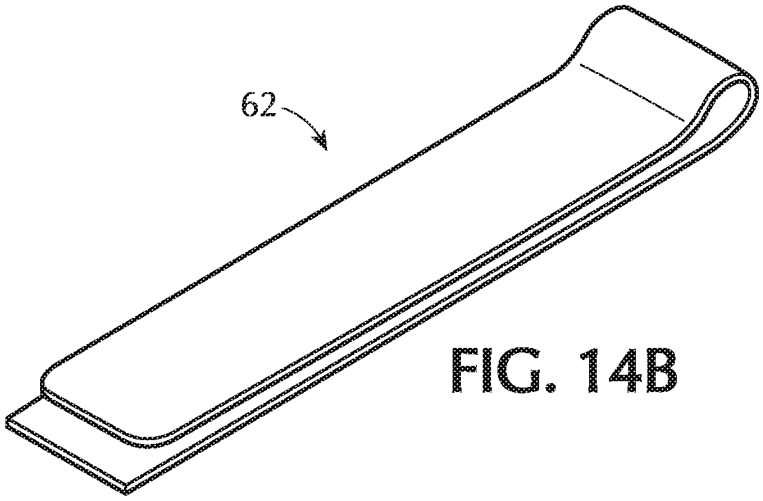
FIG. 14B illustrates an isometric view of a hook-and-loop fastening strap according to exemplary embodiments of the present invention depicted in FIGS. 1-13.
Figure 14C:
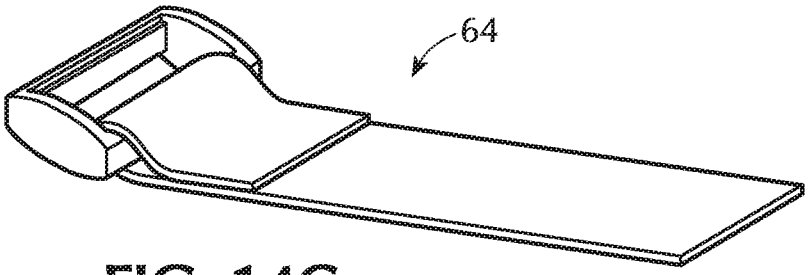
FIG. 14C illustrates an isometric view of a hook-and-loop fastening strap hook according to exemplary embodiments of the present invention depicted in FIGS. 1-13.

FIGS. 14A-C depict the carrying straps 60 and fastening means in the form of hook-and-loop fastener straps 62 and strap loops 64, as used in some preferable embodiments of the mattress 10. The hook-and-loop fastener straps 62 and strap loops 64 facilitate fastening the mattress 10 around the collapsible frame assembly 42 when the children's playpen or play-yard product 5 is in the storage/transport position. The hook-and-loop fastener straps 62 and strap loops 64 are arranged on opposite edges of the base layer fabric 28 or expandable fabric 24, as depicted in FIGS. 11A-B, such that, when the mattress 10 is folded into its square, rectangular, or other quadrilateral or multilateral shape to encircle the collapsible frame assembly 42 when each is in the storage/transport position, the edge including the hook-and-loop fastener straps 62 is adjacent to the edge including the strap loops 64. As those of ordinary skill will appreciate, the same fastening objective may be achieved through fastening means other than the hook-and-loop fastener straps 62 and strap loops 64 depicted in FIGS. 14B and 14C, such as through belt, buckle, snap, or hook style fasteners, etc.

Likewise, the carrying strap 60 is attached to the base layer fabric 28 or the expandable fabric 24 on the surface of the mattress 10 that is accessible when the mattress 10 is folded in the storage/transport position. The carrying strap 60 preferably includes a handle portion 66 to facilitate easy gripping and transport. Those of skill in the art will recognize the various arrangements and materials available for the carrying strap 60 and handle portion 66.

Figure 12:
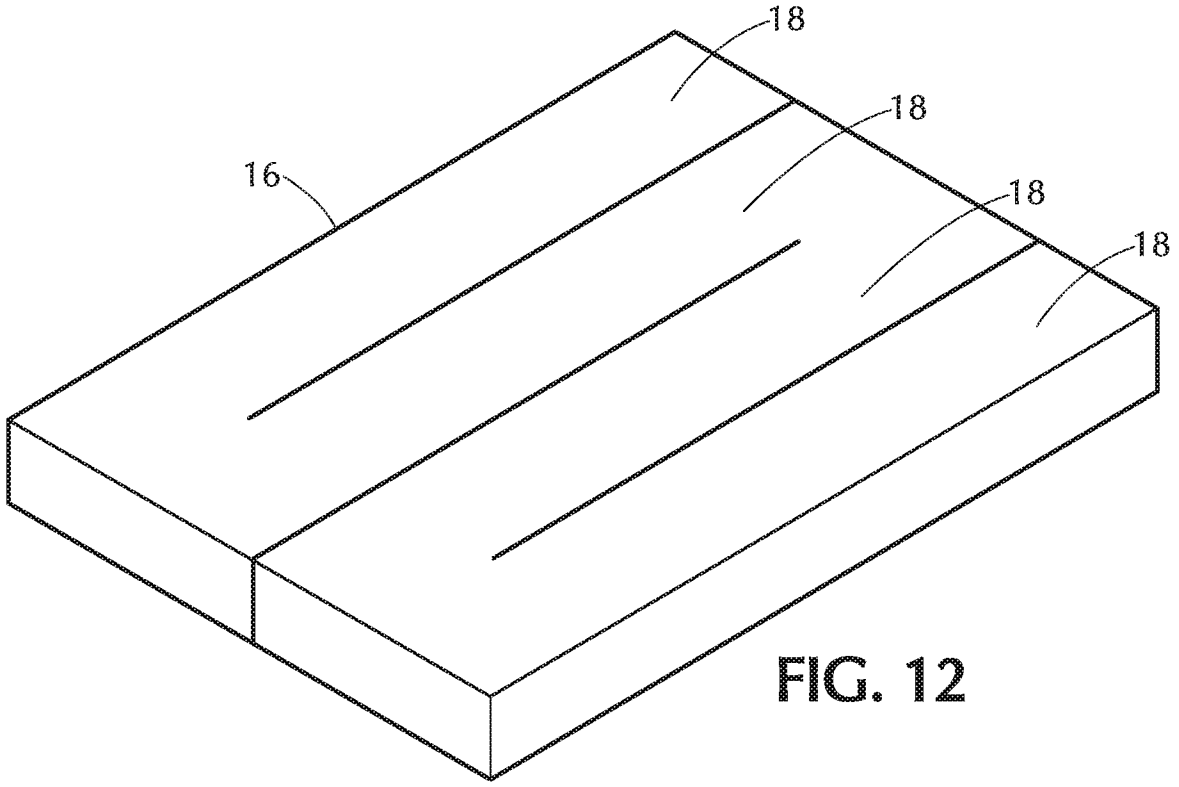
FIG. 12 illustrates an isometric view of the mattress's inflatable bladder according to the exemplary embodiments of the present invention depicted in FIGS. 1-11.
Figure 13A:
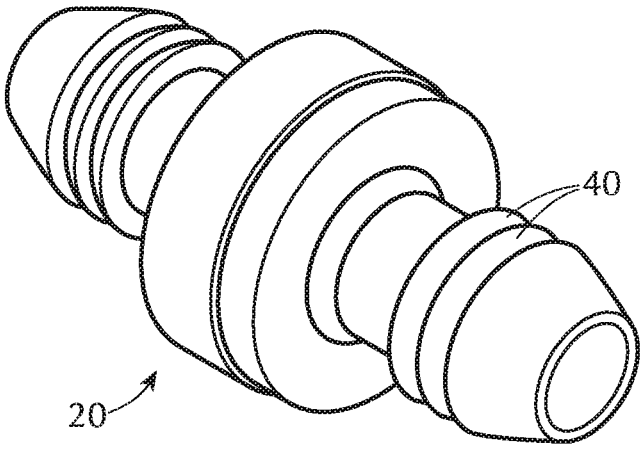
FIG. 13A illustrates an isometric view of an air valve according to exemplary embodiments of the present invention depicted in FIGS. 1-12.

Referring next to FIG. 12, a preferable arrangement of the inflatable bladder 16 with four connected air chambers 18 is depicted. The air chambers 18 in FIG. 12 are arranged in a spiral formation and are fluidly connected such that air may be introduced through a single air valve 20 to inflate all four of the air chambers 18 simultaneously. Other arrangements for the air chambers 18 are also possible, including greater or lesser numbers of chambers, chambers that are not fluidly connected and must be inflated using separate air valves, etc., as will be understood by those of ordinary skill in the art. A preferable embodiment of an air valve 20 is depicted in FIG. 13A. As shown, the air valve 20 employs grooves 40 to assist in connecting and sealing with the air delivery tube 34.

Figure 13B:
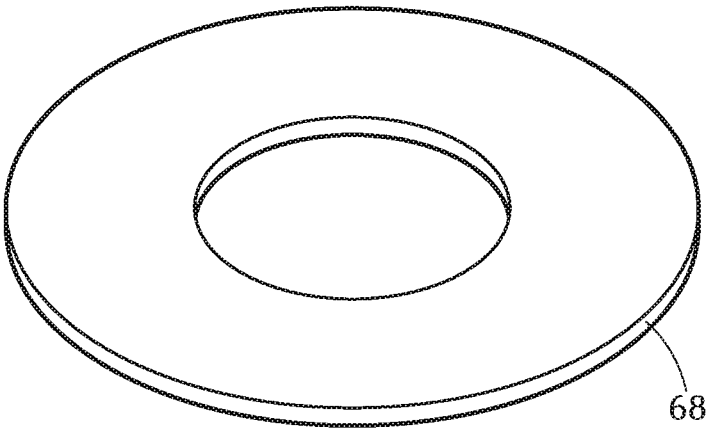
FIG. 13B illustrates an isometric view of a fabric seal according to exemplary embodiments of the present invention depicted in FIGS. 1-12.

Preferable embodiments of the mattress 10 further employ one or more fabric seals 68, a preferable embodiment of which is depicted in FIG. 13B. Fabric seals 68 are preferably employed in connection with the one or more air valves 20. As will be recognized by those of ordinary skill in the art, fabric seals 68 may be employed on the air bladder 16, the expandable fabric 24 in the area of the slots providing access to the air valves 20, etc. The fabric seals 68 assist in ensuring there is no loss of air pressure in the inflatable bladder 16 due to leakage in the area(s) of the one or more air valves 20.

While the present invention has been described with reference to particular embodiments and arrangements of parts, features, and the like, it is not limited to these embodiments or arrangements. Indeed, modifications and variations will be ascertainable to those of skill in the art, all of which are inferentially and inherently included in these teachings.

What is claimed is:

1. A mattress for use with a children's playpen or play-yard product comprising:

a hard substrate layer comprising at least three rigid substrate sections, each of the three rigid substrate sections being rotateably connected to at least one other rigid substrate section, whereby the hard substrate layer lays flat in an unpacked position and can be folded into a multilateral in a storage position;

an inflatable bladder arranged adjacent to the hard substrate layer, the inflatable bladder comprising at least one air chamber and at least one air valve, whereby the inflatable bladder can be inflated while in the unpacked position and can be deflated and folded when in the storage position;

one or more foam pads;

a non-slip sheet arranged between the inflatable bladder and the one or more foam pads; and an expandable fabric surrounding the hard substrate layer, the inflatable bladder, the non-slip sheet, and the one or more foam pads so as to prevent significant displacement of each from the others, the expandable fabric comprising a slot positioned adjacent to each of the at least one air valves of the at least one air chambers, each slot being adapted to receive an air source.

2. The mattress of claim 1, wherein the at least three hard substrate sections are comprised of a plastic or wood material.

3. The mattress of claim 1, wherein the hard substrate layer comprises four rigid substrate sections and the hard substrate layer folds into a quadrilateral when in the storage position.

4. The mattress of claim 3, wherein the hard substrate layer folds into a square when in the storage position.

5. The mattress of claim 1, further comprising a layer of the expandable fabric between the inflatable bladder and the hard substrate layer.

6. The mattress of claim 5, wherein the expandable fabric rotateably connects each of the at least three rigid substrate sections to at least one other rigid substrate section.

7. The mattress of claim 1, further comprising a layer of the expandable fabric between each of the one or more foam pads, the inflatable bladder, and the hard substrate layer.

8. The mattress of claim 1, wherein the inflatable bladder comprises four air chambers in fluid connection with one another, the four air chambers being arranged in a spiral formation.

9. The mattress of claim 1, wherein the expandable fabric further comprises a base layer fabric adjacent to the hard substrate layer, the base layer fabric comprising a more robust material that the rest of the expandable fabric, the base layer fabric further comprising at least one carrying strap with a handle and at least one fastening feature.

10. The mattress of claim 9, wherein the base layer fabric surrounds the hard substrate layer, rotateably connecting each of the at least three rigid substrate sections to at least one other rigid substrate section.

11. The mattress of claim 1, wherein the mattress measures about thirty-six inches in length and about twenty-six inches in width so as to fit snugly in a children's playpen or play-yard product's collapsible frame when the mattress is lying flat in the unpacked position, the mattress further measuring about two inches in height when the inflatable bladder is fully deflated and about four and three-quarter inches in height with the inflatable bladder is fully inflated.

12. A children's playpen or play-yard product comprising:

the mattress of claim 1;

a collapsible frame assembly that forms an enclosed entertainment environment for a child when in an assembled position and folds up for convenient storage and transport when in a collapsed position, the collapsible frame assembly comprising an outer frame, one or more base mattress supports, and wall barriers forming a fully enclosed entertainment environment, the outer frame comprising a set of upper rails, a set of lower rails, and a plurality of vertical corner posts connecting the set of upper rails and the set of lower rails at each corner.

13. The children's playpen or play-yard product of claim 12, wherein the wall barriers comprise mesh fabric wall barriers and the collapsible frame assembly further comprises corner covers, reducing the risk of injury to a child within the enclosed entertainment environment.

14. The children's playpen or play-yard product of claim 12, the collapsible frame assembly further comprising vertical legs affixed to and extending below the one or more base mattress supports.

15. The children's playpen or play-yard product of claim 12, further comprising an air compressor affixed to the collapsible frame assembly and an air tube connecting the air compressor to the at least one air valve of the mattress's inflatable bladder.

16. The children's playpen or play-yard or product of claim 12, wherein the collapsible frame assembly measures about 26×8.5×8.5 inches when in the collapsed position.

17. A mattress for use with a children's playpen or play-yard product comprising:

a hard substrate layer comprising four rigid substrate sections, each of the four rigid substrate sections being rotateably connected to at least one other rigid substrate section, whereby the hard substrate layer lays flat in an unpacked position and can be folded into a multilateral in a storage position;

a foam pad;

an inflatable bladder arranged between the hard substrate layer and the foam pad, the inflatable bladder comprising at least one air chamber and at least one air valve, whereby the inflatable bladder can be inflated while in the unpacked position and can be deflated and folded when in the storage position;

a non-slip sheet arranged between the inflatable bladder and the foam pad; and an expandable fabric surrounding the hard substrate layer, the inflatable bladder, the non-slip sheet, and the foam pad so as to prevent significant displacement of each from the other, the expandable fabric comprising:

a slot positioned adjacent to each of the at least one air valves of the at least one air chambers of the inflatable bladder, each slot being adapted to receive an air source; and a base layer fabric adjacent to the hard substrate layer, the base layer fabric comprising a more robust material that the rest of the expandable fabric, the base layer fabric further comprising at least one carrying strap with a handle and at least one fastening feature.

18. A children's playpen or play-yard product, comprising:

a mattress comprising:

a hard substrate layer comprising four rigid substrate sections, each of the four rigid substrate sections being rotateably connected to at least one other rigid substrate section, whereby the hard substrate layer lays flat in an unpacked position and can be folded into a multilateral in a storage position;

a foldable foam pad;

an inflatable bladder arranged between the hard substrate layer and the foam pad, the inflatable bladder comprising at least one air chamber and at least one air valve, whereby the inflatable bladder can be inflated while in the unpacked position and can be deflated and folded when in the storage position;

a non-slip sheet arranged between the inflatable bladder and the foam pad; and an expandable fabric surrounding the hard substrate layer, the inflatable bladder, the non-slip sheet, and the foam pad so as to prevent significant displacement of each from the other, the expandable fabric comprising:

a slot positioned adjacent to each of the at least one air valves of the at least one air chambers of the inflatable bladder, each slot being adapted to receive an air source; and a base layer fabric adjacent to the hard substrate layer, the base layer fabric comprising a more robust material that the rest of the expandable fabric, the base layer fabric further comprising at least one carrying strap with a handle and at least one fastening feature;

a collapsible frame assembly that forms an enclosed entertainment environment for a child when in an assembled position and folds up for convenient storage and transport when in a collapsed position, the collapsible frame assembly comprising:

an outer frame comprising a set of upper rails, a set of lower rails, and four vertical corner posts connecting the set of upper rails and the set of lower rails at each of four corners;

one or more base mattress supports forming a support surface for the mattress when the collapsible frame assembly is in the assembled position;

corner covers surrounding the connections of the vertical corner posts with the set of upper rails; and four mesh fabric wall barriers spanning between the set of upper rails, the set of lower rails, and two vertical corner posts forming the fully enclosed entertainment environment;

and an air compressor affixed to the collapsible frame assembly, the air compressor further comprising an air tube connecting the air compressor to the at least one air valve of the mattress's inflatable bladder, both the air compressor and the air tube being located in a position inaccessible from within the enclosed entertainment environment.

19. A mattress for use with a children's playpen or play-yard product comprising:

a hard substrate layer comprising at least three rigid substrate sections, each of the three rigid substrate sections being rotateably connected to at least one other rigid substrate section, whereby the hard substrate layer lays flat in an unpacked position and can be folded into a multilateral in a storage position;

an inflatable bladder arranged adjacent to the hard substrate layer, the inflatable bladder comprising at least one air chamber and at least one air valve, whereby the inflatable bladder can be inflated while in the unpacked position and can be deflated and folded when in the storage position;

one or more foam pads; and an expandable fabric surrounding the hard substrate layer, the inflatable bladder, a non-slip sheet, and the one or more foam pads so as to prevent significant displacement of each from the others, the expandable fabric comprising a slot positioned adjacent to each of the at least one air valves of the at least one air chambers, each slot being adapted to receive an air source, and further comprising a layer of the expandable fabric between each of the one or more foam pads, the inflatable bladder, and the hard substrate layer.

20. A mattress for use with a children's playpen or play-yard product comprising:

a hard substrate layer comprising at least three rigid substrate sections, each of the three rigid substrate sections being rotateably connected to at least one other rigid substrate section, whereby the hard substrate layer lays flat in an unpacked position and can be folded into a multilateral in a storage position;

an inflatable bladder arranged adjacent to the hard substrate layer, the inflatable bladder comprising at least one air valve and four air chambers in fluid connection with one another, the four air chambers being arranged in a spiral formation, whereby the inflatable bladder can be inflated while in the unpacked position and can be deflated and folded when in the storage position; and an expandable fabric surrounding the hard substrate layer and the inflatable bladder so as to prevent significant displacement of each from the other, the expandable fabric comprising a slot positioned adjacent to each of the at least one air valves, each slot being adapted to receive an air source.

* * * * *